United States Patent [19]

Knudsen

[11] 4,230,028

[45] Oct. 28, 1980

[54] MACHINE FOR INSTALLING INSERTS IN CONTAINER LIDS

[76] Inventor: David S. Knudsen, 3145 Hawthorne Blvd., St. Louis, Mo. 63104

[21] Appl. No.: 963,011

[22] Filed: Nov. 22, 1978

[51] Int. Cl.[3] ..... B21D 43/18

[52] U.S. Cl. ..... 93/1.3; 93/36 B; 113/114 R; 113/80 D

[58] Field of Search ..... 93/1.3, 36 B, 55.1 M, 93/55.1 R, 39.1 R, 39.2; 113/114 R, 80 D, 80 DA; 29/235; 156/261, 262, 520, 521, 497

[56] References Cited

U.S. PATENT DOCUMENTS

| | | | |
|---|---|---|---|
| 3,191,508 | 6/1965 | Beamish | 93/36 B |
| 3,328,873 | 7/1967 | Schweers | 113/114 R |
| 3,332,209 | 7/1967 | Knudsen | 53/313 |
| 3,959,061 | 5/1976 | Renck et al. | 113/80 D |
| 4,084,488 | 4/1978 | Kinney | 93/36 B |

*Primary Examiner*—Robert Louis Spruill
*Assistant Examiner*—K. Y. Lin
*Attorney, Agent, or Firm*—Gravely, Lieder & Woodruff

[57] ABSTRACT

A machine for installing disk-like inserts in container lids having axially directed flanges includes an indexing table on which several lid holders are mounted. The table moves the lid holders into and out of several stations. At the first station the lids are loaded into the holder which maintains them in an upright disposition with their flanges projected outwardly. At another station punches blank the inserts from sheet material, while plungers carry the blanked inserts forwardly beyond the punches and deposit them in the lids. The plungers have rigid forward faces provided with vacuum ports to that atmospheric air holds the blanked inserts against the plungers. As the plungers approach the lids at this station, they pass through apertures which are smaller than the inserts, and as a consequence the peripheral portions of the inserts are turned backwardly. This enables the inserts to enter the flanges of their respective lids without acquiring wrinkles and further enables them to maintain a centered disposition. At a subsequent station, seating heads move into the lids and deform the peripheral portions of the inserts into annular depressions in the lids. This has the further effect of ironing out the inserts at their peripheral portions to insure the complete absence of wrinkles and irregularities and also directs the peripheral edges of the inserts behind shoulders on the flanges of their respective lids. At the final station the lids are discharged.

21 Claims, 15 Drawing Figures

FIG. 3
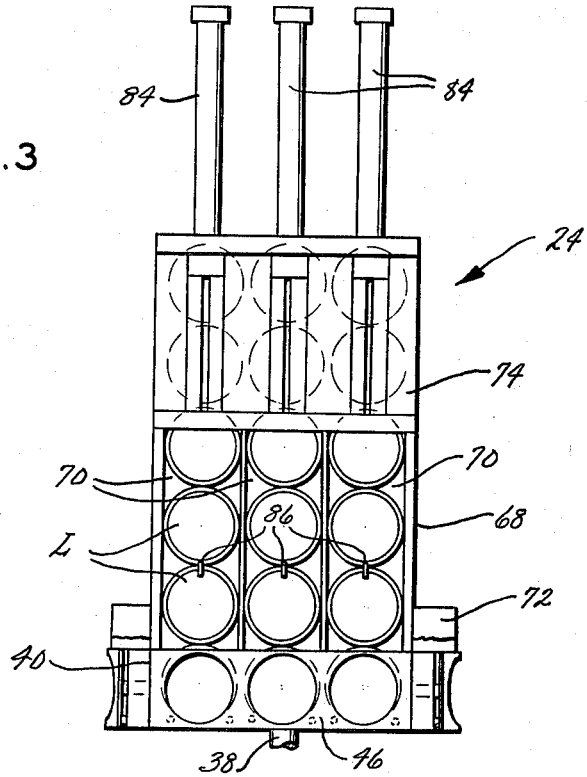
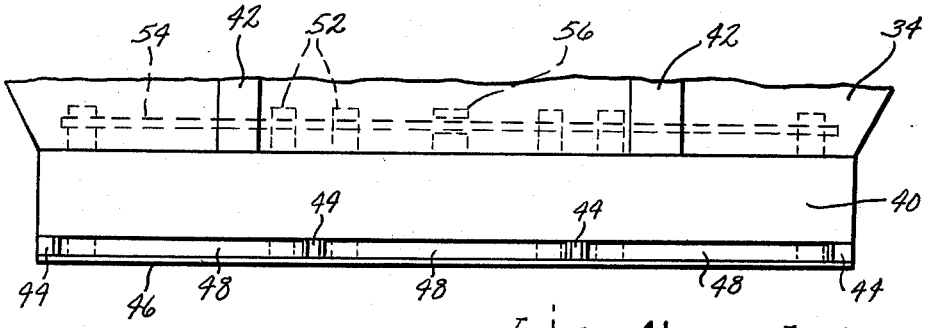
FIG. 4c
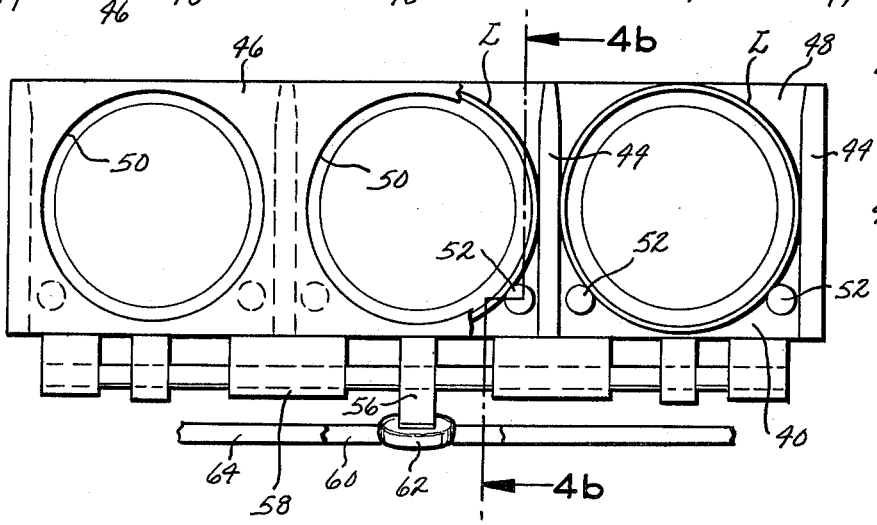
FIG. 4a
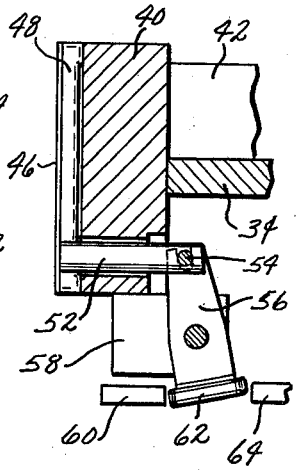
FIG. 4b

FIG. 10
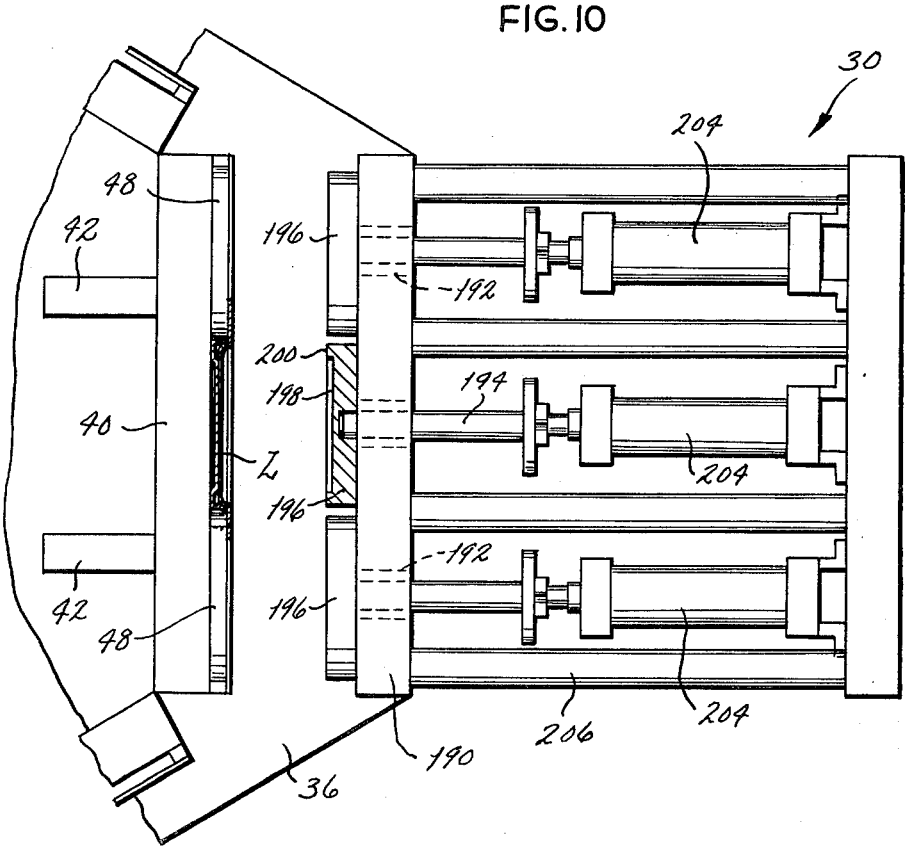
FIG. 9a
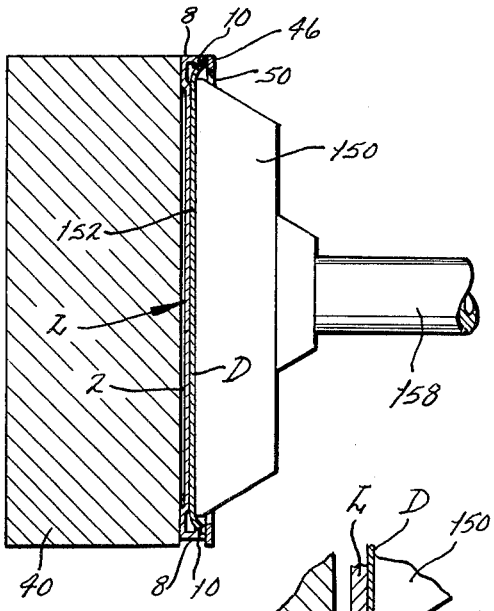
FIG. 11a
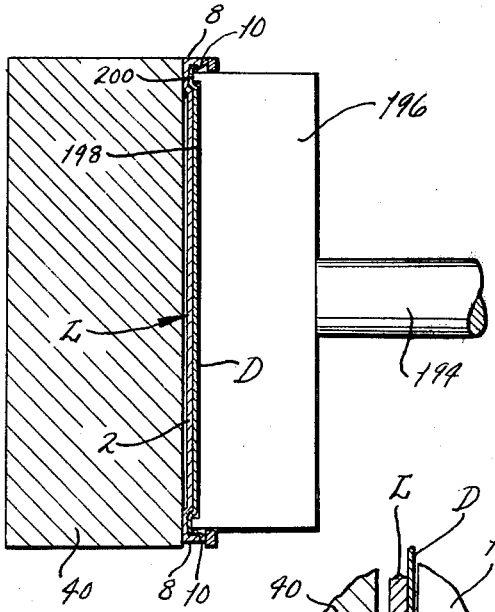
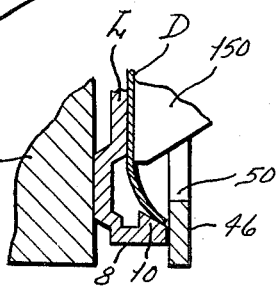
FIG. 9b
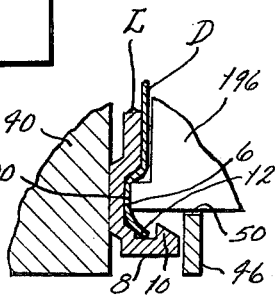
FIG. 11b

MACHINE FOR INSTALLING INSERTS IN CONTAINER LIDS

BACKGROUND OF THE INVENTION

This invention relates in general to the sealing of containers and more particularly to a machine and process for installing inserts in container lids.

One of the most effective ways to seal a container, particularly a food container having a large mouth, is to interpose a foil seal between the mouth of the container and the lid which fits over that mouth. Preferably, the metal foil is attached directly to the mouth of the container independently of the lid so that even if the lid is removed, the contents of the container are still protected from contamination. The lid, of course, may serve as a closure after the foil has been broken to gain access to the contents in the container. Plastic containers lend themselves quite well to this type of sealing arrangement, since their rims when heated become pliant and tacky. The heated container rims thus adhere to the foil seal, and at the same time conform to any irregularities in it. Furthermore, by induction heating the foil, the heat necessary for effecting the seal may be localized so as not to damage the remainder of the container or harm its contents.

U.S. Pat. No. 4,095,390 discloses a machine and process for rapidly heat sealing foil disks to the mouths of plastic containers on an assembly line basis. However, the machine and process function best when the foil disks are retained in the lids as the lids are installed on the containers. In other words, it is desirable to place the lid and foil disk on the container as a unit and then heat seal the foil to the container mouth, instead of first placing the seal disk over the container mouth, then perhaps heat sealing, and finally installing the lid. Indeed, the lid serves to protect the foil disk as the disk and lid are handled. The lid further holds the foil disk flat as it is placed on the container mouth and guides the foil disk into a concentric disposition with respect to the mouth. Even so, wrinkles and other irregularities sometimes occur in the foil disk at the location where the plastic container mouth adheres to it, and these irregularities can produce a defective or incomplete seal.

SUMMARY OF THE INVENTION

One of the principal objects of the present invention is to provide a machine for rapidly installing disk-like inserts in container lids which are subsequently installed over the mouths of containers. Another object is to provide a machine of the type stated which further cuts the inserts from foil sheet. A further object is to provide a machine of the type which installs the inserts in a perfectly concentric position. An additional object is to provide a machine of the type stated which installs the inserts without imparting wrinkles or other irregularities to them so that the inserts are ideally suited for subsequent heat sealing. These and other objects and advantages will become apparent hereinafter.

The present invention is embodied in a machine including backing means for positioning a flanged lid, a plunger formed from a rigid material and having vacuum ports that open out of its front face, means for aligning an insert with the front face of the plunger, and means for driving the plunger into the flange of the lid. The invention is also embodied in a machine having a plunger that is smaller than the insert and a retaining member having an aperture through which the plunger moves as it approaches the lid, so that the peripheral portion of the insert is turned backwardly. The invention is further embodied in a machine having indexing means that moves lid holders past a plurality of stations, loading means at one of the stations for loading lids into the holders, and inserting means at another of the stations for blanking inserts from sheet material and for installing the inserts in the lids. The invention also consists in the parts and in the arrangements and combinations of parts hereinafter described and claimed.

DESCRIPTION OF THE DRAWINGS

In the accompanying drawings which form part of the specification and wherein like numerals and letters refer to like parts whenever they occur:

FIG. 3 is an elevational view along line 3—3 of FIG. 1 and showing the lid loading assembly;

FIG. 4*a* is a front elevational view of one of the backing blocks of the indexing table, with the retaining plate of the backing block being partially broken away;

FIG. 4*b* is a sectional view of the backing block taken along line 4*b*—4*b* of FIG. 4*a* and further showing one of the positioning pins of the lid positioning assembly.

FIG. 4*c* is a top plan view of the backing block shown in FIG. 4*a;*

FIG. 9*a* is an enlarged sectional view showing the plunger in its fully extended position within a lid on the opposite backing block;

FIG. 9*b* is an enlarged sectional view showing typical disposition of the peripheral portion for the foil disk as it is deposited in the lid by the plunger;

FIG. 10 is a plan view taken along line 10—10 of FIG. 1 and showing the seating assembly with its seating heads in their retracted positions;

FIG. 11*a* is a sectional view showing one of the seating heads in its fully extended position, in which case it deforms the peripheral portion of the foil disk into the annular depression of the lid; and FIG. 11*b* is an enlarged fragmentary view showing the disposition of the peripheral portion of the foil disk after being deformed by the seating head.

DETAILED DESCRIPTION

Figures 1, 2:
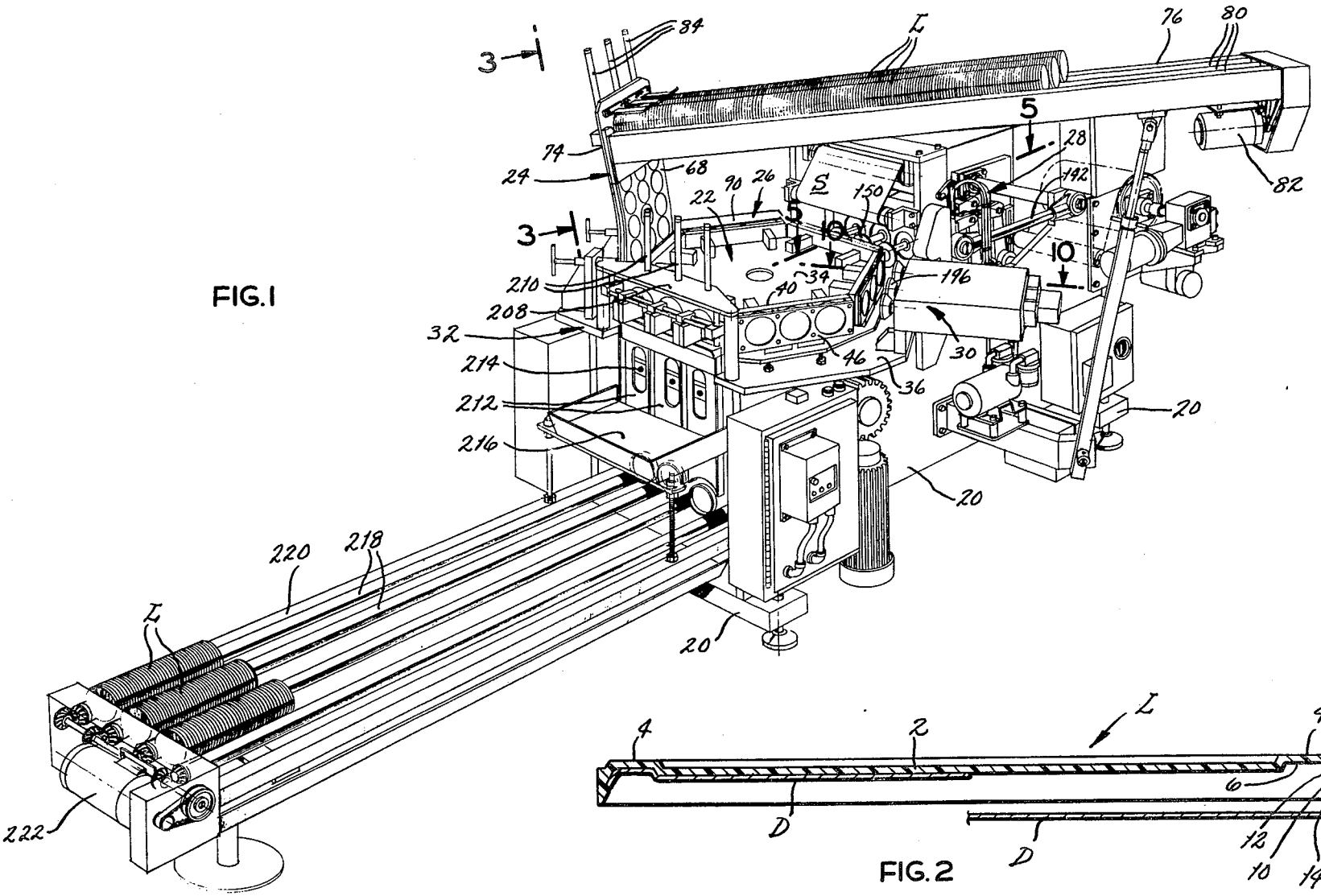
FIG. 1 is a perspective view of a machine constructed in accordance with the present invention.
FIG. 2 is a sectional view of a lid showing in half section a foil disk removed from the lid and in another half section foil disk properly installed in the lid.

Referring now to the drawings, A (FIG. 1) designates a machine which cuts inserts in the form foil disks D from foil sheet S and deposits the disks D in lids L, thus rendering the lids L suitable for closing food and similar containers. In this regard both the lid L and its disk D when installed on a container extend across and close the mouth of the container. The disk D may be heat sealed to the container mouth by passing it through a rapidly oscillating magnetic field, so as to heat it, while at the same time forcing it downwardly against the mouth of the container. The heated disk D melts the plastic material at the container mouth, while the downwardly directed force insures that the disk and container bond together along the full periphery of the disk D. A machine for heat sealing the disks D to the container mouths is disclosed in U.S. Pat. No. 4,095,390, but this machine operates most effectively when the disks D are contained within the lids L so that the lids L and disks D are installed on the container mouths as units.

The lid L should at least be somewhat flexible and is preferably molded from a flexible plastic material such as polyethylene. It has a closure portion 2 (FIG. 2) which is large enough to cover the mouth of the particular container for which the lid L is designed. For the most part the closure portion 2 is flat, but at its periphery it is offset backwardly to provide a raised land 4 and a depression 6 in front of the land 4, both being of annular configuration. The depression 6 opens downwardly, that is in the axial direction, and is wide enough to accommodate the rim that surrounds the mouth of the container. Its major surface area is perfectly flat and lies in a plane perpendicular to the axis of the lid L. The lid L further includes an axially directed flange 8 which is joined to the closure portion 2 along the full periphery thereof and extends downwardly from the depression 5, that is, in the direction in which the depression 6 opens. The flange 8 has an inwardly directed rib 10 that is spaced from the closure portion 2 so that an inwardly opening groove 12 is formed behind the rib 10, that is, adjacent to the depression 6 in the closure portion 2. The rib 10 is designed to interlock with an outwardly directed lip or rib on the rim of the container so as to retain the lid L on the container. To facilitate installation on the container, the rib 10 has a beveled surface 14 leading up to the groove 12. When the foil disk D is installed properly in the lid L, it is deformed into the annular depression 6 and its peripheral edge lies in the groove 12 located behind the rib 10 (FIG. 2—left side). Moreover, no wrinkles or other irregularities exist in it, at least in that portion of its area that is within the depression 6.

The machine A includes (FIG. 1) a main frame 20 and an indexing table 22 which is supported on the frame 20 and moves incrementally past six stations, namely: (1) a loading station, (2) a positioning station, (3) an inserting station, (4) a seating station, (5) a blank station, (6) and a discharge station. Located at the loading station is a lid loading assembly 24 which loads the lids onto the table 22 in an upright position. When the table 22 indexes, these lids L move to the positioning station where a lid positioning assembly 26 exerts a slight amount of force on the lids L to insure that they are seated in the correct positions. At the inserting station, to which the lids L are advanced the next time the table 22 indexes, is an inserting assembly 28 which cuts foil disks D from a large foil sheet S and deposits them in the lids L. Once the lids L into which the foil disks D have been inserted are advanced to the seating station, a foil seating assembly 20, located at that station deforms the peripheral portions of the disks D into the depressions 6 of the lids L and further insures that the peripheral portions are free from wrinkles and are projected into the grooves 12 of the flanges 8. The lids L drop from the table 22 at the discharge station where a discharge assembly 32 is located.

The indexing table 22 includes a hexagonal dial plate 34 which is mounted in a horizontal disposition for rotation above a tooling plate 36 that is fixed in position on the frame 20. To this end, the dial plate 34 is at its center fastened to a vertical shaft 38 (FIG. 3) that is confined in bearings on the frame 20. The shaft 38 extends downwardly through the tooling plate 36, below which it is connected to a drive mechanism that is capable of turning it in 60° increments so that each time the shaft 38 is turned, a different side edge of the dial plate 34 is presented at the loading station and the other stations as well. Thus, each turn of the shaft 38 presents a different side edge of the dial plate 34 opposite to the five basic assemblies 24, 26, 28, 30 and 32.

In addition to the dial plate 34, the table 22 includes six backing blocks 40 (FIG. 4), each of which is positioned against a different side edge of the dial plate 34. Each has a vertical front face that is presented outwardly away from the edge of the plate 34. The backing blocks 40 are not only bolted against the side edges of the dial plate 34, but are also bolted against reinforcing blocks 42 that are in turn bolted to the top surface of the dial plate 34. The front face of each backing block 40 is perfectly flat and fastened to these faces are vertical guide bars 44, the spacing between which is slightly greater than the diameter of the lids L. In depth, each bar 44 is slightly deeper than the thickness of the lids L, and bolted across the forward faces of the guide bars 44 is a retaining plate 46. This creates three side-by-side pockets 48 across the front of each backing block 40, with each pocket 48 being just wide enough and deep enough to loosely accommodate a single lid L without excessive free motion in the lateral direction. To facilitate entry of the lids L into the pockets 48, the bars 44 are beveled slightly at their upper ends. At each pocket 48, the retaining plate 46 has a circular aperture 50 that is centered with respect to its pocket 48 and is about the same diameter as the inside diameter of the rib 10 on the flange 8 of a lid L, but is slightly smaller in diameter than the disk D. Since the lids L are somewhat larger in diameter than the apertures 50, they will not fall forwardly through the apertures 50.

Projecting forwardly from each backing block 40 near its lower edge are a series of positioning pins 52 (FIG. 4), there being two pins 52 for each pocket 48. These two pins 52 are offset toward the sides of the pocket 48 and indeed are arranged such that when the flange 8 of a lid L rests upon them, it will be perfectly concentric with the circular aperture 50 for that pocket 48. Assuming that the flange 8 is directed forwardly, that is away from the dial plate 34, the circular margin of the aperture 50 will register with the rib 10 on the lid L located behind it. While the pins 52 normally project beyond the front face of the backing block 40, they are retractable into the block 40 so as to enable the lids to fall from their respective pockets 48 and away from the indexing table 22. To this end the pins 52 normally project beyond the back face of the backing block 40 where a common activating rod 54 extends through all of them. Midway between its ends, the rod 54 is received between the furcations of an activating lever 56 that pivots on a bracket 58 attached to the underside of the backing block 40. At its lower end the lever 56 is provided with a roller follower 60 that moves along two cams 62 and 64 that are fastened to the tooling plate 36 on the frame 20. These cams 62 and 64 are configured such that the positioning pins 52 remain in their extended positions when at all stations except the discharge station where the discharge assembly 32 is located. As the dial plate 34 turns and brings a backing block 40 into the discharge station, the cam 64 forces the lower end of the activating lever 56 forwardly, and this in turn moves the upper end rearwardly, thereby retracting the pins 52 so that they no longer obstruct the lower ends of the pockets 48. The lids L in those pockets 48 thus drop from the table 22.

The lid loading assembly 24 (FIGS. 1 & 3) inserts the lids L into the pockets 48 along the backing blocks 40, forcing them downwardly from above, three at a time, so that all the pockets 48 along a block 40 are filled simultaneously. In order to direct the lids L into the pockets 48 at the first station, the loading assembly 24 is provided with a guide 68 having three side-by-side channels 70 extending downwardly through it, and each of these channels 70 is large enough to accommodate a single row of lids L. The guide 68 need be nothing more than spaced apart sheets with narrow strips separating the sheets and forming the three channels 70, but the entire guide 68 should have a limited amount of flexibility. The lower end of the guide 68 is secured to a mount 72 which in turn is fixed firmly to the tooling plate 34, the arrangement all being such that the lower ends of the three channels 70 in the guide 68 align with the three pockets 48 that are at the loading station. At its upper end the guide 68 supports a loading head 74 at which lids L are driven downwardly into the three channels of the guide 70. The lids L are contained in a trough 76 (FIG. 1) that extends from the head 74 generally over the indexing table 22. While one end of the trough 76 is fixed firmly to the head 74 and supported by it, the other end is supported on an adjustable strut 78. Thus, extending or retracting the strut 78 will change the inclination of the trough 76, and this change in inclination is accommodated by the flexibility of the guide 68. The trough 76 contains four parallel rods 80 which support the lids L in three parallel rows, with the lids L in each row being arranged such that their flanges 8 are axially aligned and projected forwardly toward the loading head 76. The rods 80 are coupled with an electric motor 82 located at the free end of the trough 76, and that motor rotates the rods 80 to cause the lids L on them to migrate downwardly toward the loading head 76.

The loading head 76 above each vertical row of lids L is provided with a double acting air cylinder 84, the piston rod of which carries a finger (not shown) that is adapted to engage the flange 8 on the leading lid L in the row of lids L beyond it, and to drive that lid L downwardly into the aligned channel 70 of the guide 68. The stroke of the cylinder 84 is about the same as the diameter of lids L so that each time the cylinder 84 is energized at its cap end, the lids in the guide channel 70 below it advance the diameter of one lid L. Moreover, the length of the guide channel 70 is such that the lowermost lid L is located immediately above the aligned pocket 48 of the indexing table 22, yet does not interfere with the movement of a backing block 40 into the first station. The loading head 76 and its cylinders 84 are very similar to the corresponding mechanisms disclosed in U.S. Pat. No. 3,332,209 which is incorporated herein by reference. Accordingly, the head 76 will not be described in greater detail.

Opposite the lowermost lid L in each channel 70, the guide 68 is fitted with a retractable hook 86 which prevents the lowermost lids L from falling out of the channel 70 when not supported by the lids L in the pockets 48 of one of the backing blocks 40. The hook 86 retracts when the cylinder 84 for its channel 70 is energized. Once the cylinder 84 is energized, the downward movement of the lids L through the guide 68 forces the lowermost lid L almost completely into the aligned pocket 48 of the table 22. In most instances the lids L drop downwardly onto the two positioning pins 52 at the bottom of the pocket 48.

The lid positioning assembly 26 (FIG. 1) at the second station insures that all of the lids L in the pocket 48 at the positioning station are resting on the positioning pins 52, in which case the lids L are precisely concentric with respect to the circular apertures 50 in overlying retaining plate 46. The positioning assembly 26 is basically a plate 90 beneath which each backing block 40 passes as it moves into the second station. The plate is positioned such that any lids L which rise above the top surfaces of the block 40 are contacted at their flanges 8 and forced downwardly against the positioning pins 52.

The foil inserting assembly 28, which is located at the inserting station, blanks foil disks D from a foil sheet S, forces those disks through the apertures 50 in the retaining plate 46 that is at the inserting station, and lodges them within the lids L so they are retained in the lids L by the flanges 8, although perhaps somewhat insecurely. At the inserting station the frame 20 extends both outwardly from the table 22 and upwardly above it to support the foil inserting assembly 28.

The inserting assembly 28 includes a die shoe 100 (FIGS. 5 & 8) that is mounted firmly on the frame 20 opposite the backing block 40 that is in the inserting station. The shoe 100 has three bores 102 which axially align with the three apertures 50 in the retaining plate 46 for the block 40, but are slightly larger in diameter than the foil disk D as cut from the foil sheet S. Bolted against the back face of the shoe 100, that is the face whith is presented away from the table 22, is a die plate 104 having circular die openings 106 that axially align with the bores 102 and apertures 50 in the shoe 100 and retaining plate 46, respectively, but the diameter of these openings is precisely the diameter of the foil disks D, for the disks D are blanked through them.

Above the die plate 104 the frame 20 supports several rollers 108 (FIG. 8) along which foil sheet S extends, and beyond the rollers 108, the sheet S drops vertically and passes along the back face of the die plate 104. The sheet S is wide enough to overlie all three openings 106 in the die plate 104, and the rollers 108 maintain the sheet S in a position in which it does overlie those openings 106. One of the rollers 108 is connected to a drive mechanism which rotates it incrementally at proper intervals so as to advance the sheet S, with each incremental advance being slightly in excess of the diameter of the foil disks D. The drive mechanism for driven roller 108 is synchronized with the drive mechanism for the indexing table 22, with the synchronization being such that the foil sheet S advances each time the table 22 indexes.

At its two ends the die shoe 100 is fitted with leader pins 120 (FIGS. 5 & 6) which project rearwardly from it with their axes being parallel to the axes of the bores 102 in the shoe 100 and the circular openings 106 in the die plate 104. Moreover, the leader pins 120 at one end of the shoe 100 are spaced far enough from the pins 120 at the other end to enable the foil sheet S to pass between the two sets of pins 120 so that the leader pins 120 do not interfere with the advancement of the foil sheet S. The leader pins 120 project through bushings 122 which are in turn press-fitted into a punch plate 124 that is located behind the die shoe 100 and die plate 104. The leader pins 120 and bushings 122 enable the punch plate 124 to reciprocate toward and away from the die plate 104 while maintaining perfect alignment with the die plate 104, all this being necessary by reason of the fact that the punch plate 104 carries three circular punches 126 which project forwardly therefrom for the purpose of blanking the foil disks D from the foil sheet S. Consequently, the punches 126 are about the same diameter as disks D and the die openings 106 and must align with the die openings 106 so as to enter them when the punch plate 124 moves forwardly. Each end the punch plate 124 is provided with journals 128 (FIG. 5) that project laterally, and these journals are fixed firmly in position on the plate 124.

The punch plate 124 carries a pressure plate 130 (FIGS. 5, 6, & 8) that is supported beyond the front face of the plate 124 on two leader pins 132 (FIG. 5) which are secured in the plate 124, and at their opposite ends are received in bushings 133 mounted on the plate 130, so that the pressure plate 130 can move toward the punch plate 124. However, the pressure plate 130 is urged away from the punch plate 124 by compression springs 134 (FIG. 6) which encircle shoulder bolts 136 that restrain the pressure plate 124. The pressure plate 130 possesses a flat front face which is opposite the flat surface area on the back of the die plate 104, yet the plate 130 contains cutouts that enable the punches 126 on the plate 124 to pass through and beyond the flat front face of the pressure plate 130. Normally the punch plate 124 is backed off sufficiently to enable the foil sheet to move freely between the die plate 104, on one hand, and the pressure plate 130 and punches 126, on the other. However, when the punch plate 124 moves forwardly, the pressure plate 130 comes into contact with the foil sheet S, clamping it against the back face of the die plate 104. As the movement continues, the springs 134 that separate the punch and pressure plates 124 and 130 compress, clamping the foil sheet S even more firmly against the back of the die plate 104. Thereafter the punches 126 pass beyond the pressure plate 130 and enter the circular opening 106 of the die plate 104, and in so doing blank circular disks D from the foil sheet S. Since the remainder of the foil sheet S is clamped tightly between the die plate 104 and the pressure plate 130, no tendency exists for it to draw inwardly through the die opening 106. On the contrary, the disks D are cut with a clean shearing action. This clamping is particularly advantageous in the case of extremely thin foil on the order of 1.5 to 4 mils.

Along its lower margin, the pressure plate is provided with a knife 137 (FIGS. 6 & 8) that passes close to the lower edge of the die plate 104 and cuts the foil sheet S that extends below the die 104, so that the severed portion falls downwardly. Each severed portion falls downwardly. Each severed portion of course has three large holes, representing the areas from which the disks D were blanked.

The movement necessary to effect the foregoing clamping and blanking is acquired from a crank shaft 138 (FIG. 5) that extends across the frame 20 directly behind the journals 128 on the punch plate 124. This shaft has eccentric journals 140 at its ends, and connecting the journals 128 of the plate 125 and the journals 140 of the shaft 138 are drive rods 142. Thus, as the crank shaft 138 rotates, its eccentric journals 140 move the drive rods 142 forwardly and rearwardly, and the rods 142 in turn cause the punch plate 124 to reciprocate on the leader pins 120, one revolution of the shaft 138 being required to move the punch plate 124 forwardly and then rearwardly back to its starting point.

Figure 5:
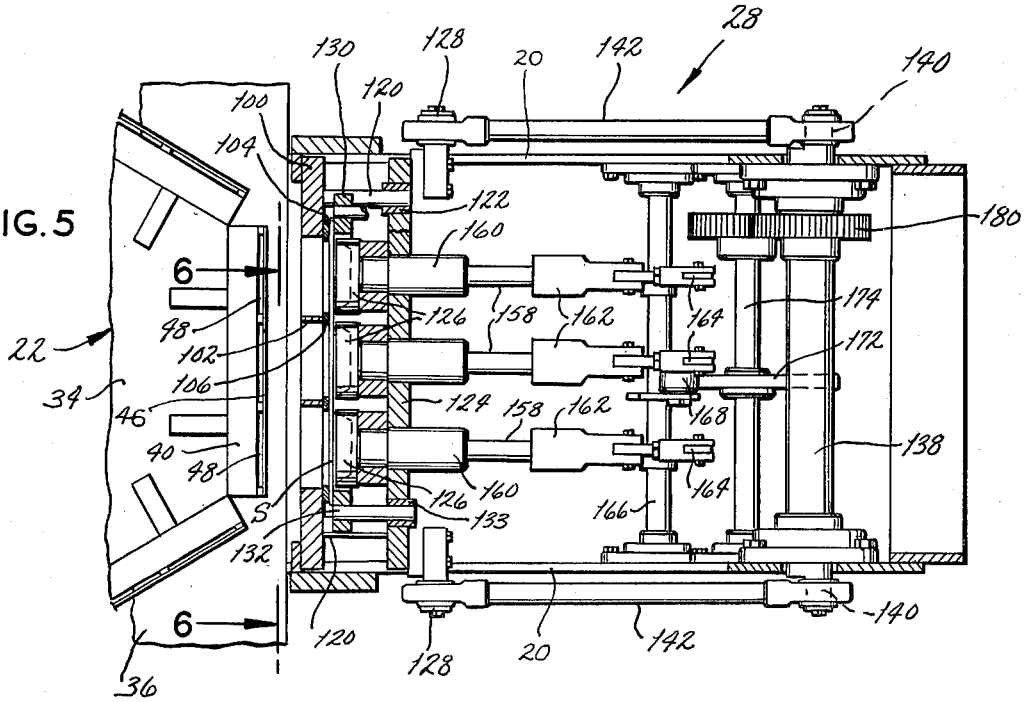
FIG. 5 is a sectional view taken along line 5—5 of FIG. 1 and showing the inserting assembly which deposits the foil disks in the lids, with the punches and plungers of that assembly being in their fully retracted positions.
Figure 6:
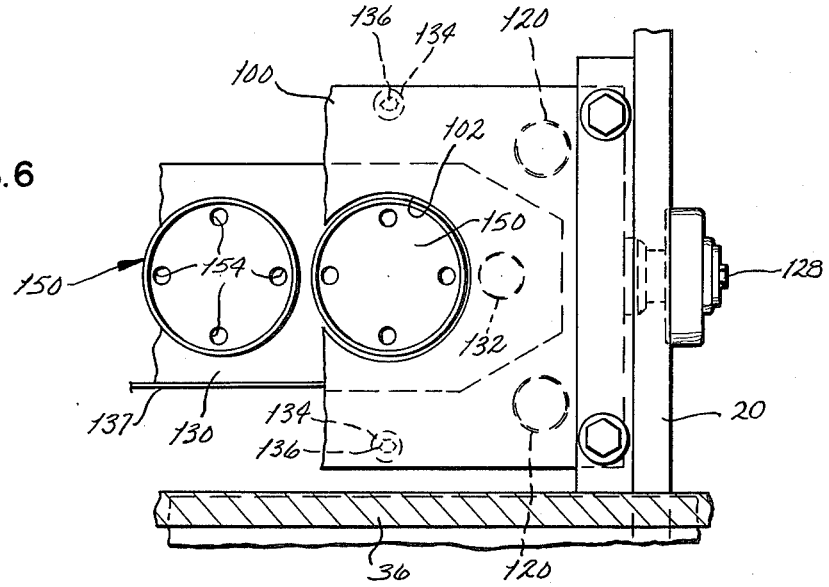
FIG. 6 is a fragmentary sectional view taken along line 6—6 of FIG. 5 and showing the front faces of the plungers that carry the foil disks into the lids.

The three punches 126 that project from the punch plate 124 are not solid, but instead each has a forwardly opening cavity 146 (FIG. 8), the diameter of which is almost as large as that of the punch 126 itself so that the punch 126 has a relatively thin side wall. The interior surface of this wall is for the most part cylindrical, but at its forward end this surface merges into a beveled seating surface 148 that diverges forwardly. The cavity 146 of each punch 126 contains a plunger 150 which is normally housed entirely within the confines of the cavity 146, at least when the punch plate 124 is in its rearmost position (FIG. 5). The plunger 150 is formed from a rigid material such as stainless steel and has a flat front face 152 (FIG. 6) and a beveled back face, the latter of which seats against the seating surface on the punch 124 when the plunger 150 is fully retracted into the cavity 146. When the plunger 150 is so disposed, its flat front face lies slightly behind the leading or cutting edge of the punch 126, or at least is no further forwardly than flush with the plane of the cutting edge. The plunger 150 has a series of ports 154 that open out of its flat forward face, generally near the periphery of punch 124.

Each plunger 150 at the center of its rear surface is threaded onto a hollow push rod 156 (FIG. 8) that extends rearwardly through a guide sleeve 158 mounted firmly on the punch plate 124. The hollow interior of the rod 156 communicates with the several ports 154 in the plunger 150 through passages that extend through the body of the plunger 150. The guide sleeve 158 extends along the push rod 156 for a substantial distance and while confining the rod 156 in the radial direction, it nevertheless permits the rod to move forwardly in the axial direction, in which case the plunger 150 leaves the cavity 146 of its punch 126 and moves forwardly away from the punch 126. The sleeve 158 has pressure line 160 connected with it and when the plunger 150 is at its forwardmost position the line 160 communicates with the hollow interior of the rod 156 to supply pressurized air to the ports 154. At its rear end, each push rod 156 is fitted with an adapter 162 which serves several functions. First the adapter serves to connect the hollow interior of the push rod 156 with a vacuum 163 so that the ports 154 are subjected to a reduced pressure. Secondly, the adapter 162 functions as a pivotal connection between rod 156 and an operating lever 164 that pivots about the axis of a cross shaft 166 which is mounted on the frame 20 slightly ahead of and below the crank shaft 138, and in so doing moves the push rod 156 and the plunger 150 forwardly and rearwardly. Finally, the adapter 162 acts as a shock absorber for accommodating further movement of the operating lever 164 after the plunger 150 ceases to move forwardly as a result of having bottom out on a backing block 40 of the table 22.

The cross shaft 166 has three operating levers 164 (FIG. 8) attached firmly to it, there being a separate lever 164 for each plunger 150 and its push rod 156. While the levers 164 are secured firmly to the shaft 166 such as by welding, the ends of the shaft 166 are in bearings which are bolted to the frame 20, and accordingly when the shaft 166 turns in its bearings all three operating levers 164 move in unison. One of the levers 166 constitutes the primary lever 164 and it extends both above and below the cross shaft 166 where it is provided with roller followers 168 and 170. The follower 168 bears against a cam 172 on a camshaft 174, while the follower 170 bears against a cam 176 on a camshaft 178. The two camshafts 174 and 178 are coupled together and also to the crank shaft 138 through suitable gearing 180 such that all three shafts 138, 174 and 178 rotate in unison and at equal velocity. In short, a one-to-one ratio exists in the gearing 180 for the three shafts, so that a single turn imparted to the shaft 174 will impart a single revolution to the shafts 138 and 178 which are connected to it through the gearing 180. Indeed, the end of the camshaft 174 is connected with a drive mechanism which rotates that shaft through one revolution each time it is energized. Moreover, the drive mechanism is synchronized with the drive mechanisms for the table 22 and for the foil sheet S all such that it rotates the camshaft 174 only after the table 22 has indexed to its next position and the foil sheet S has come to rest between the die and pressure plates 104 and 130.

Figure 7:
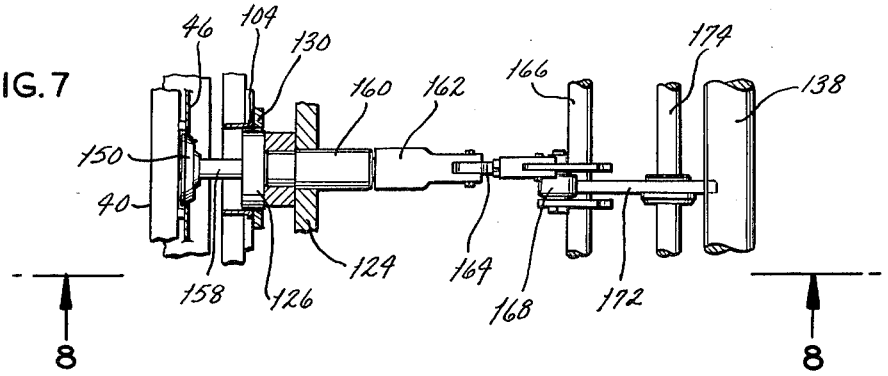
FIG. 7 is a sectional view similar to FIG. 5, but showing one of the punches and its plunger in their fully extended positions, with the latter depositing a foil disk in a lid.
Figure 8:
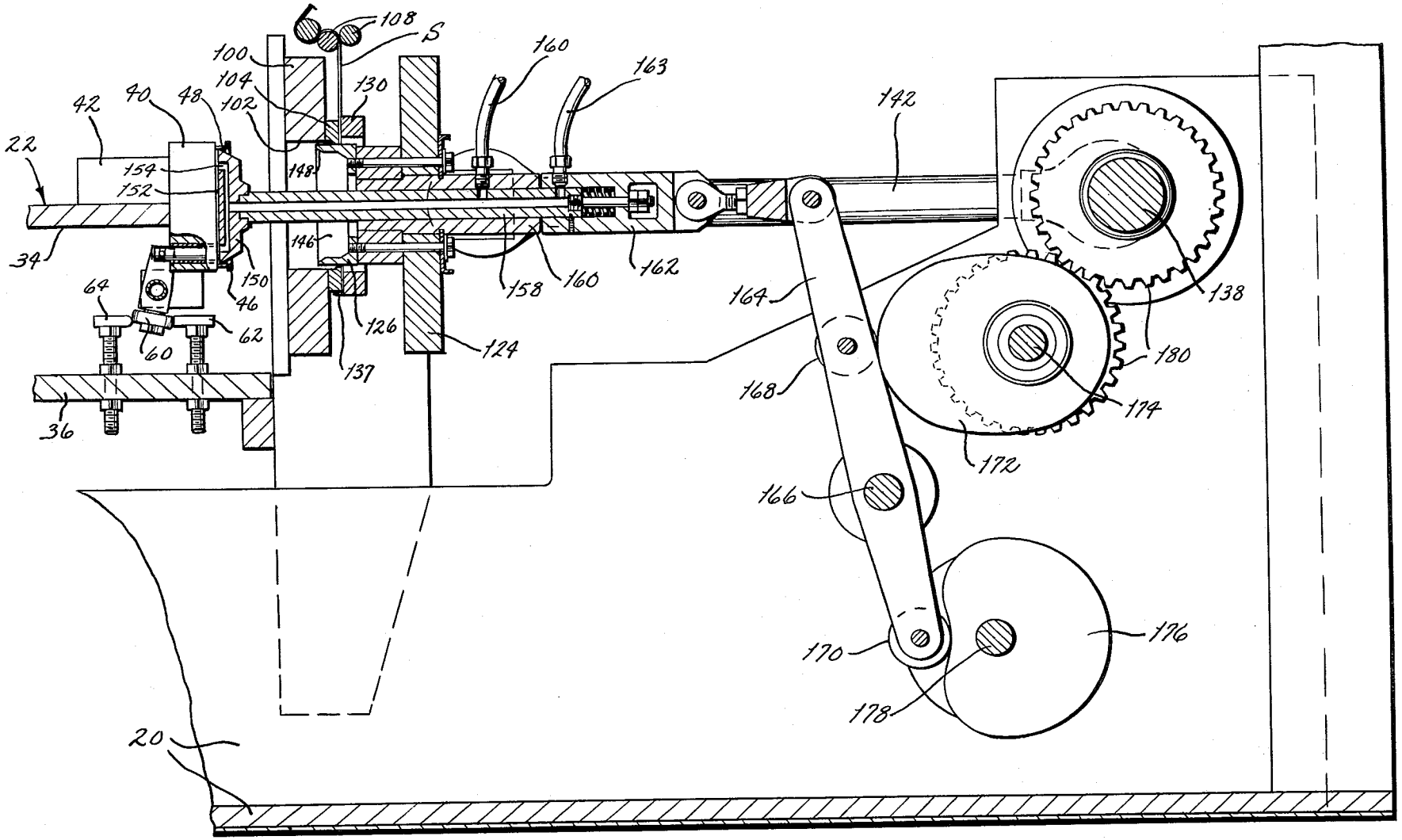
FIG. 8 is a sectional view taken along line 8—8 of FIG. 7.

The two cams 172 and 176 are configured to maintain the levers 166 and likewise the push rods 156 and plungers connected with them under positive cam control for the full 360° of rotation imparted to the cam shafts 174 and 178. Thus, while the upper cam 172 may drive the upper ends of the levers 166 forwardly and thereby extend the push rods 156, the lower cam 174 prevents the roller follower 168 from leaving the surface of the cam 174. Similarly, when the lower cam 176 retracts the push rods 156 by driving the lower end of the primary lever 166 forwardly, the upper cam 172 prevents the roller follower 170 from leaving the surface of the cam 176. No opportunity exists for lost motion in the levers 166 or the push rods 156 and plungers 150 driven thereby. Aside from that, the configuration of the two cams 172 are such that the punches 126 and plungers 150 move forwardly together in unison until the punches 126 blank the three foil disks D from the foil sheet S, and this occurs at about 90° rotation of the shaft 138 away from top dead center, that is away from that position of the shaft 138 in which its eccentric journals 140 are located rearmost. Thereafter, both the punches 126 and the plungers 150 move forwardly together until the crank shaft 138 reaches bottom dead center, but the plungers 150, being under control of the cam 172 move considerably further than the punches 126 (FIGS. 7 & 8). Indeed, the plungers 150 move all the way through the apertures 102 in the die shoe 100, and beyond the die shoe 100 and into the circular apertures 50 of the retaining plate 46 that overlies the pockets 48 at the third station. The movement of the plungers 150 terminates when their flat front faces 152 are adjacent to the closure portions 2 of lids L in the pockets 48. At this time the pressure lines 160 are operative and supply high pressure air to the ports 154 of the plunger 150. During the next 90° of rotation for the shaft 138, both the plungers 150 and the punches 126 retract, but the plungers 150 retract much more rapidly than the punches 126 and rejoin the punches 126 in their fully recessed position at 270° of rotation. Through the final 90° of rotation for the shaft 138, the plungers 150 and punches 126 move in unison.

Returning now to the instant that each punch 126 blanks a foil disk D from the foil sheet S, the disk D extends across the hollow end of the punch 126 and in effect closes the end of the punch 126. By virtue of the reduced pressure at the forwardly exposed ports 154 in the plunger 150, the separated disk D is forced by atmospheric air against the flat front face 152 of the plunger 150 and is retained in the position as the plunger 150 advances forwardly away from punch 126. No opportunity exists for the disk D to shift radially on the plunger 150. Furthermore, since the front face of the plunger 150 is flat and perfectly rigid, the separated disk D does not acquire any wrinkles. In this regard the disk D is fully supported against the flat front face 152, except in the relatively small peripheral area that projects beyond the periphery of the disk and in the small areas that overlie the ports 154. As to the former, the pressure on each side of it is equal so no tendency to wrinkle occurs at this area. The latter, that is the ports 154, are set inwardly from the area of the heat seal so even if slight irregularities develop at the ports 154, they do little damage, but even so the tendency to wrinkle is almost nonexistent since the areas of the ports 154 are quite small. The flat surface 152 of the plunger 150, that is the surface area against which the disk D is supported exclusive of the ports 154 and unsupported peripheral areas should amount to between 70% and 90% of the total area of the disk D.

As the plunger 150 continues to advance, it moves the foil disk D through the bores 102 in the die shoe 100 and then through the aligned circular aperture 50 in the retaining plate 46 on the indexing table 22. Since the aperture 50 in the retaining plate 46 is smaller in diameter than the disk D, the unsupported peripheral portion of the disk D is deformed rearwardly at the edge of the aperture 50 as the plunger 150 moves through the aperture 50. However, no wrinkles occur since the remainder of the disk D is supported against the firm flat surface 152 of the plunger 150. The deformation places the foil disk D in a configuration that enables it to pass along the rib 10 of the lid L without wrinkling and to further engage the rib 10 sufficiently to remain in the lid L after the punch 150 withdraws (FIG. 9). The plunger 150 advances until the supported portion of the foil disk D is against the closure portion 2 of the lid L, at which time the vacuum applied at the ports 154 is released and the ports 154 are pressured by air supplied through the line 160. This insures that the disk D remains with the lid L and is not withdrawn from it. Even so, it is possible to operate satisfactorily by merely venting the interior of the rods 156 when the plunger 150 reaches its forwardmost position. In this case, the disk D will engage the rib 10 of the lid L along its periphery and will remain in the lid L. In many instances the peripheral edge of the disk lies at least partially into the peripheral groove 12 that is behind the rib 10.

Typically, the cams 172 and 176 and the eccentric journals 140 on the crank shaft 138 are configured and arranged such that the following relative motions are derived, with top dead center of the shaft 138 being the reference point:

| Angular position of shaft 138 | Movement of punch 126 | Movement of plunger 150 |
|---|---|---|
| TDC–90° | 9/16" | 9/16" |
| 90°–180° (BDC) | 9/16" | 3⅜" |
| 180°–270° | 9/16" | 3⅜" |
| 270°–TDC | 9/16" | 9/16" |

The top dead center position for the shaft 138 is the position at which the eccentric journals 140 are located rearmost.

The disks D, which are inserted into the lids L at the inserting station, are further deformed along their peripheries and properly seated in the lids L at the seating station by the foil seating assembly 30 (FIG. 10). The seating assembly 30 includes a slide block 190 that is firmly anchored on the tooling plate 36 and projects upwardly therefrom with its faces parallel to the retaining plate 46 of the backing block 40 that is at the seating station. The slide block 190 contains three bushings 192 through which transfer rods 194 extend, and these rods axially align with the circular apertures 50 in the retaining plate 46 that is in the seating station. In other words, the axis of each rod 194 coincides with the axis of an aperture 50 in the retaining plate 46. Each rod 194 at its forward end, that is at the end presented toward the retaining plate 46, is fitted with a seating head 196 that is circular in configuration and only slightly smaller in diameter than the diameter of the aperture 50 and the inside diameter of the rib 10 on the lid L. Indeed, the head 196 is designed to pass through the aperture 50 and into the lid L without wedging into the flange 8 on the lid L (FIG. 11). The head 196 has a front face 198 that is for the most part flat, but along its periphery has a raised land 200 which is offset forwardly from the remainder of the front face 198. The land 200, which is annular in configuration, aligns with the annular depression 6 in the lid L and is sized to fit into that depression when the seating head 196 is in its forwardmost position.

The transfer rods 194 are connected with the piston rods of double acting air cylinders 204 (FIG. 10), there being a separate cylinder 204 for each transfer rod 194. These cylinders 204 are mounted on a small frame 206 that is in turn attached to the rigid slide block 190, and each cylinder 204 is positioned such that it axially aligns with the transfer rod that it operates. Normally, the transfer rods 194 are in a retracted position in which their seating heads 196 are retracted from the retaining plate 46 on the table 22 and are located adjacent to slide block 190. However, when compressed air is applied to the cap ends of the cylinders 204, the cylinders 204 drive the transfer rods 194 forwardly. As the rods 194 extend, the seating heads 196 pass first through the circular apertures 50 in the retaining plate 46 and then into the flanges 8 of the lids L located behind the retaining plate 46. During the last increment of movement for each seating head 196, the land 200 on the front face 198 of that seating head 196 enters the annular depression 6 in the lid L and deforms the peripheral portion of the foil disk D into that depression (FIG. 11). As this deformation occurs, the peripheral portion of the foil disk D is to a limited measure drawn over the outside edge of the land 200, and this in turn displaces the extreme outer portion of the disk D from a generally axial disposition where it is for the most part inside the rib to a more oblique disposition where its peripheral edge is behind the rib 10, that is within the groove 12. At the same time, the land 200 on the seating head 196 irons out the portion of the disk D that will eventually be sealed to the container rim, that is the portion within the depression 6, so as to make that portion as flat as possible and eliminate any wrinkles or irregularities from it. In this regard the forward motion of each rod 194 is limited by the lid L into which it extends, so that the seating head 196 in effect bottoms out in the lid L. Thereafter the seating head 196 is withdrawn from the lid L and the retaining plate 50 by directing compressed air into the rod end of the cylinder 204. Since the peripheral edge of the disk D is in the groove 12 of the lid L, the disk D does not follow the seating head 196 as the head 196 withdraws from the lid L. Thus, the seating head 196 insures that the foil disk D is engaged with the lid L so that the disk D will not fall out of the lid L during subsequent handling and installation on a container, and further insures that the portion of the disk within the depression 6 is in the best possible condition for heat sealing.

The cylinders 204 are operated by valves which are synchronized with the lid carrying table 22 such that the transfer rods 194 and the seating heads 196 on them extend and retract while the table 22 is at rest.

The blank station is for some further operation that the operator of the machine may deem desirable, or it may be left blank.

At the discharge station, the lids L fall from the table 22 and are collected in the discharge assembly 32 (FIG. 1). In this regard, the cam 64 on the tooling plate 36 moves the actuating lever 56 for each backing block 40 as that block 40 approaches the discharge station during indexing of the table 22, and by the time the block 40 comes to rest at this station, the lever 56 has completely retracted the positioning pins 52 into the block 40. This, of course, opens the bottoms of the three pockets 48, enabling the lids L drop from the pockets 48.

The discharge assembly 32 includes (FIG. 1) a mount 208 that is secured to the tooling plate 36, and this mount has three small air cylinders 210 positioned on it with their piston rods projected downwardly. Each piston rod aligns with a different pocket 48 in the backing block 40 that is at the discharge station, and is long enough to enter that pocket when pressurized air is admitted to its cylinder 210. The cylinders 210 dislodge any lids L that may remain in the pockets 48 after the positioning pins 52 have retracted.

In addition, the discharge assembly 32 includes chutes 212 that align with the lower ends of the pockets 48 in the backing blocks 40 at the discharge station, there being a separate chute 212 for each pocket 48. The chutes 212 extend downwardly from the blocks 40, and have electronic scanning devices and air nozzles 214 located along them. The scanning devices observe the lids L as they pass downwardly through the chutes 212, and look for the reflective surface of the disks D within the lids L. Only when a scanning device does not observe a reflective surface does it energize the air nozzle 214 with which it is associated. The air nozzle 214 is oriented such that it will blow the lid L out of the chute 212 and onto a tray 216 located along the chute 212. This, of course, eliminates all lids L which for some reason or another have not received a disk D.

Those lids L which pass completely through the chutes 212 drop onto a series of parallel collecting rods 218 which are inclined downwardly at a slight angle to form three side-by-side collecting troughs 220. The rods 218 are rotated by a motor 222 so that the lids L move away from the lower ends of the chutes 212.

OPERATION

The machine A contains six stations, five of which are active, and with each 60° rotation of the indexing table 22, some operation on a lid L occurs at each of the five active stations. However, for purposes of discussion it is much easier to follow a single lid L around the table from the first station to the sixth station, describing the various operations that occur at the several stations.

Starting with the loading station, the operator of the machine A loads lids L into the troughs 76 (FIG. 1) with the flanges 8 of those lids L projected toward the loading head 74. The rotating rods 80 of the troughs 76 cause the lids L to migrate downwardly toward the head 74. When the air cylinders 84 are energized, the endmost lids L move into the upper ends of the channels 70 that lead downwardly to the pockets 48 at the first station. Indeed, the uppermost lids L which are advanced directly by the air cylinder 84 force all of the preceding lids downwardly through the channels 70 a distance equaling the diameter of a lid L (FIG. 3). As a consequence, the lowermost lids L in the channels 70 are driven into the open upper ends of the pockets 48 and advanced downwardly through the pockets 48. In most instances, the lids L come to rest on the positioning pins 52 (FIG. 4*a*).

Once the lids L are loaded into the pockets 48 at the first station, the table 22 indexes, bringing those lids L to the positioning station. Here, the lids L pass under the plate 90, and any lids L that have not fully entered their respective pockets 48 are forced downwardly against the positioning pins 52 at the bottom of the pockets 48. An adhesive may be applied to the closure portion of the lids L at this station.

Next, the table 22 is indexed to bring the properly positioned lids L to the inserting station where foil disks D are inserted into the lids L (FIGS. 5–9). Specifically, as the table 22 indexes the lids L to the inserting station, the drive mechanism for the foil sheet S rotates one of the rollers 108 over which the foil sheet S passes, and that roller in turn advances the foil sheet S a distance slightly greater than the diameter of the foil disks D. Once the indexing table 22 and the sheet S come to rest, the drive mechanism for the three shafts 138, 174 and 178 rotates those shafts in unison and at the same velocity. As a consequence, shaft 138 propels the punch plate 12 forwardly, which brings the pressure plate 130 against the foil sheet S, clamping the foil sheet S tightly between the forward surface of the pressure plate 130 and the back surface of the die plate 124. As the punch plate 124 continues forwardly, so do the punches 126 which are mounted rigidly upon it. At the same time the cam 172 on the shaft 174 moves the plungers 150 forwardly. After about 90° of rotation for the shafts 138, 174 and 178 the punches 126 blank the foil disks D from the sheet S and these disks D are retained on the plungers 150 by the vacuum to which their ports 154 are subjected. In other words, atmospheric air forces the disks D against the flat front faces 152 of the plungers 150. Thereafter, the plungers 150 continue to move forwardly much more rapidly than the punches 126 and toward the forwardmost end of their strokes they pass through the circular apertures 50 in the retaining plate 46 and then into the flanges of the lids L in the pockets 48 (FIGS. 7 & 8). Upon passing through the circular apertures 50, the unsupported peripheral portions of the foil disks D are turned rearwardly and enter the flanges 8 of the lids L in that disposition. The plungers 150 drive the disks D all the way to the closure portions 2 of the lids L, and upon reaching that position the turned back peripheral portions tend to lodge against the inside surfaces of the flange ribs 10 (FIG. 9). At this point, the vacuum is released and pressurized air is admitted to the ports 154. This insures that the disks D remain in the lids L and do not follow the plungers 150 as the plungers 150 retract. The plungers 150 are retracted by the other cam 176 and move into the hollow portions of the punches 126, whereupon the punches 126 and plungers 150 retract together and the pressure plate 130 releases the foil sheet S.

After the foil disks D are installed in the lids L at the inserting station, the table 22 indexes the lids L to the seating station. Once the table 22 comes to rest with the lids L at the seating station, the air cylinders 204 are energized (FIG. 10), and they drive the seating heads 196 forwardly through the circular apertures 50 of the retaining plate 46 and into the flanges 8 of the lids L (FIG. 11). During the last increment movement, the raised lands 200 on the forward faces of the seating heads 196 deform the foil at the peripheral portions of the disks D into the annular depressions 6 in the lids L, and as this occurs the extreme outer portions of the disks D draw over the peripheral edges of the lands 200. This brings the edges of the disks D into the inwardly opening grooves 12 in the lids L, in which case those edges are disposed behind the inwardly directed ribs 10 (FIGS. 2 & 11*b*). This insures that the disks D are in effect interlocked with the lids L and will not easily fall out of the lids L during subsequent handling. The seating heads 196 further tend to iron out those portions of the disks D that are disposed within the depressions 6. It is these portions along which heat seals are formed with the container rims, so that it is very desirable to make these surfaces as flat as possible and to keep them completely free of wrinkles and irregularities. Thereupon, the seating heads 196 retract, but the disks D remain in the lids L.

The next time the table 22 indexes, the lids L come to the blank station where no operation is performed.

The next indexing movement of the table 22 brings the lids L to the discharge station, and as the backing block 40 approaches that station, the cam 64 on the tooling plate 36 shifts the actuating lever 56 which in turn retracts the positioning pins 52. By the time the table 22 comes to rest, the positioning pins 52 at the discharge station are fully retracted. At this time the air cylinders 210 are energized and they drive the lids L out of the pockets 48 and into the chutes 212. The chutes 212 direct the lids L into the collecting troughs 220 where they are collected and removed.

While the backing blocks 40, which hold the lids L as they move through the various stations, are on the rotating table 22, they may also be mounted on a conveyor that moves in a straight line past these various stations. Also, the machine A is suitable for blanking disks D from a wide variety of sheet material and not just foil sheet.

This invention is intended to cover all changes and modifications of the example of the invention herein chosen for purposes of the disclosure which do not constitute departures from the spirit and scope of the invention.

What is claimed is:

1. A machine for installing a thin, highly flexible insert into a container lid having a closure portion that is sized to extend across and close the mouth of a container and a flange that extends from the closure portion and is configured for engaging the container around its mouth; the closure portion having an inside face that is presented toward the interior of the container when the lid is in place, said machine comprising: backing means for positioning the lid in a predetermined position with the inside face of the closure portion accessible; a retaining member mounted in a fixed position with respect to the backing means and immediately beyond the flange on the lid, the retaining member having an aperture that aligns with the flange, the aperture being slightly smaller than the insert, yet of generally the same peripheral configuration; a plunger having a forwardly presented smooth flat face that is rigid and a plurality of ports which open out of the smooth face near the periphery of the plunger, the plunger having generally the same peripheral configuration as the aperture in the retaining member, yet being smaller than the aperture so that the plunger can fit into the aperture and move toward the closure portion of the lid, the configuration of the aperture and plunger being such that when the plunger is in the aperture, the space between the periphery of the plunger and the wall of the aperture is substantially greater than the thickness of the material of the insert; means for moving the plunger into and out of the aperture; means for placing an insert against the smooth face of the plunger when the plunger is out of the aperture, said means including a blanking punch and a blanking aperture into which the punch moves to blank and insert from a sheet of thin flexible material, the blanking aperture being larger than the aperture in the retaining member; and means for placing the ports of the plunger under a partial vacuum as the plunger advances toward and into the aperture so that atmospheric air holds the insert against the plunger as the plunger moves toward the aperture, whereby the peripheral portion of the insert will be deformed backwardly as the insert passes into the aperture to thereby facilitate its entry into the lid.

2. A machine for installing a thin highly flexible insert in a container lid having a closure portion that is configured to extend across and close the mouth of a container and a flange that extends from the closure portion for engaging the container, the closure portion having an inside face that is presented toward the interior of the container when the lid is in place, said machine comprising: backing means for positioning the lid in a predetermined position with the inside face of its closure portion accessible; a die shoe located opposite the backing means such that the inside face of the closure portion for the lid in the backing means faces the die shoe, the die shoe having an aperture that aligns with the lid in the backing means and is the size and configuration of the desired insert; a pressure plate located behind the die shoe and being shiftable toward and away from the die shoe; means for positioning a sheet of thin highly flexible material between the die shoe and the pressure plate; a blanking punch that is capable of moving toward and away from the die shoe and is sized to fit into the aperture of the die shoe so as to blank an insert from the sheet of thin flexible material when advanced into the aperture from behind the die shoe; a plunger normally contained within the punch and being extendable from it sufficiently to carry a blanked insert through and beyond the aperture in the die shoe, the plunger having a substantially flat and firm forwardly presented surface against which the blanked insert locates as the punch and plunger advance into the die shoe aperture, the plunger further having a plurality of ports which open out of its flat forwardly presented surface near the periphery of that surface; drive means for forcing the pressure plate toward the die shoe to clamp the sheet material between the plate and die shoe, for thereafter advancing the punch into the die shoe, for projecting the plunger forwardly from the punch after the punch blanks the insert from the sheet material, with the forward projection being sufficient to bring the forward face of the plunger into the vicinity of the lid, and for returning the plunger, punch, and pressure plate back to their initial positions; means for placing the ports of the plunger under a partial vacuum as the plunger advances toward the lid in the backing means so that the blanked insert will be held against the flat front face of the plunger by atmospheric air and for thereafter releasing the vacuum so that the blanked insert remains in the vicinity of the lid; a seating head offset from the plunger and being wider than the plunger, yet narrower than the inside of the flange; indexing means for moving the lid from a position opposite the plunger to a position opposite the seating head; and additional drive means for moving the seating head into the lid to seat the insert securely in the lid.

3. A machine according to claim 2 wherein the plunger advances into the flange of the lid, and when in its forwardmost position, the flat front face of the plunger is adjacent to the inside face on the lid.

4. A machine according to claim 2 wherein the plunger is smaller than the punch in that the punch extends laterally beyond the plunger.

5. A machine according to claim 1 wherein the forwardly presented smooth face of the plunger is substantially flat.

6. A machine for installing thin highly flexible inserts in container lids of the type having a closure portion that extends across the mouth of its container and includes a continuous surface area that overlies the rim that forms the mouth of the container and a flange that projects axially from the closure portion for engaging the container to hold the lid on the container, the closure portion having an inside face that is presented toward the interior of the container when the lid is in place, said machine comprising: a plurality of holding means each for holding at least one lid such that the inside face of its closure portion is accessible, each holding means including a backing surface against which the opposite face of the lid closure portion is located, so as to provide a backing at least in the region of the flat surface for the closure portion; indexing means for moving each holding means into and out of a plurality of stations, one of which is an inserting station and another of which is a seating station; inserting means at the inserting station for blanking an insert from a thin sheet of material and for advancing the insert toward the lid holding means at said one station and positioning it opposite the inside face of the closure portion of the lid; and seating means at the seating station and including a seating head having a land that aligns with the continuous surface area on the lid closure portion in the holding means at the seating station, and means for moving the seating head toward and away from the lid, with the advance toward the lid being sufficient to tightly compress the insert in the region of the continuous surface area on the lid between that surface area and the land of the seating head so that the insert in the region of the continuous surface area is free from wrinkles.

7. A machine according to claim 6 and further comprising: means for releasing the lids from the holding means after the seating means bears against and compresses the insert against the continuous surface area of the lid.

8. A machine according to claim 6 wherein yet another of the stations is a loading station which precedes the inserting station, and further comprising loading means at the loading station for loading lids into that holding means that is at the loading station.

9. A machine according to claim 6 wherein the continuous surface area of the lid is the base of a depression that is along the flange and at the periphery of the closure portion; and wherein the land on the seating head is raised and aligns with the depression so as to enter the depression when the seating head is extended into the lid.

10. A machine according to claim 6 wherein the inserting means further positions the insert opposite the inside face of the lid with the peripheral area of the insert turned generally backwardly away from the closure portion of the lid.

11. A machine according to claim 4 and further comprising a retaining member located on the backing means immediately in front of the free edge of the flange, and having an aperture that is slightly smaller in size than the opening in the die, yet of generally the same configuration, and wherein the plunger moves the insert through the aperture in the retaining member, whereby the peripheral portion of the insert is turned backwardly.

12. A machine according to claim 2 wherein the drive means comprises at least one cam and means coupling the cam and plunger; a shaft that rotates at a fixed velocity with respect to the cam and has an eccentric portion thereon, a punch plate on which the punch is carried, and a drive rod connecting the eccentric portion on the shaft and the punch plate.

13. A machine according to claim 2 wherein the closure portion of the lid adjacent to the flange has a depression and the flange has an inwardly opening groove; and wherein the seating head on its front face has a raised land which aligns with and fits into the depression in the lid so as to deform the insert into the depression and cause its periphery to be directed outwardly into the groove.

14. A machine according to claim 1 wherein the lid is circular and its closure portion further has an annular depression adjacent to the flange and its flange has a groove opening inwardly at the depression; and further comprising a seating head having a front face provided with a raised land that aligns with the annular depression and means for moving the seating head through the aperture in the retaining member and into the flange of the lid with the plane of the raised land substantially parallel to the closure portion in the lid, whereby the land deforms the peripheral portion of the insert into the annular depression and flattens it against the surface of the depression to form a wrinkle-free sealing surface, the peripheral portion of the insert further being drawn over the edge of the raised land as that portion is deformed and in so doing being directed outwardly into the groove, whereby the insert is retained securely in the lid.

15. A machine according to claim 6 wherein the indexing means also moves the holding means into and out of a discharge station located after the seating station; and further comprising means for releasing the lid from the holding means at the discharge station.

16. A machine according to claim 6 wherein the inserting means comprises a frame, a die plate mounted in a fixed position on the frame and having an opening located opposite to and in alignment with the lid located in the holding means at the inserting station, the opening being the same size and configuration as the insert, means for positioning the thin sheet immediately behind the die plate, a punch sized to fit through the opening in the die plate; first drive means for moving the punch between a retracted position, wherein it is spaced from the die plate, and an extended position, wherein it is in the opening of the die plate, whereby an insert will be blanked as the punch moves from the retracted to the extended positions, a plunger mounted on the punch and having vacuum ports opening out of its forward face, second drive means for moving the plunger between retracted and extended positions, the plunger when in the retracted position having its front face generally at the leading edge of the punch, the plunger when in its extended position being located substantially beyond the punch and within the lid with its front face adjacent to the closure portion on the lid that is at the inserting station, and means for placing the vacuum port at a pressure of less than atmospheric as the plunger moves from its retracted to its extended positions, whereby an insert blanked from the sheet will be held against the front face of the plunger by atmospheric air as the plunger carries the insert into the container lid.

17. A machine according to claim 16 wherein the plunger is slightly narrower than the insert that it carries into the lid so that a narrow portion of the insert projects behind the plunger; and wherein the holding means includes a retaining member that is located in front of the lid that is carried by the holding means, the retaining member having an aperture that is beyond the flange on the lid, the aperture being slightly smaller than the inset, yet larger than the plunger, whereby as the plunger moves through the aperture in the retaining member, the peripheral portion of the insert is turned backwardly.

18. A machine according to claim 8 wherein the holding means holds the lids with their closure portions in generally upright disposition, and the loading means comprises a guide member having a channel that extends downwardly toward the top of the backing means at the loading station and is long enough to hold a plurality of lids, one after the other, with their closure portions generally in the same plane, a trough inclined downwardly toward the guide member and having its lower end at the channel, the trough being configured to hold a multitude of lids such that their closure portions are parallel and located one after the other, and means for engaging the first lid in the trough and for driving it into the channel a sufficient distance to drive the lowermost lid in the channel out of the channel and into the holding means.

19. A machine according to claim 18 wherein the trough is secured to the guide member and the guide member is flexible so that the inclination of the trough can be varied.

20. A machine according to claim 6 wherein the indexing means comprises a table that rotates about a vertical axis in angular increments, wherein the holding means comprise holders that are on the table and hold the lids with their closure portions positioned upright and their flanges protruding outwardly, and wherein the inserting means is located beyond the periphery of the table.

21. A machine according to claim 20 wherein the table moves the lid holders to a discharge station; and wherein the holders include retractable support elements which support the lids and retain them in the holders; and further comprising means for retracting the support elements at the discharge station to enable the lids to fall from the holders.

* * * * *